United States Patent [19]

Sladky

[11] Patent Number: 4,848,447

[45] Date of Patent: Jul. 18, 1989

[54] TUBE-TYPE HEAT EXCHANGER AND LIQUID DISTRIBUTOR HEAD THEREFOR

[76] Inventor: Hans H. Sladky, Fabriciusstr. 16, Hamburg, Fed. Rep. of Germany

[21] Appl. No.: 249,422

[22] Filed: Apr. 10, 1989

Related U.S. Application Data

[63] Continuation-in-part of Ser. No. 892,947, Aug. 4, 1986, Pat. No. 4,799,542, which is a continuation-in-part of Ser. No. 628,017, Jul. 5, 1984, abandoned.

[30] Foreign Application Priority Data

Jul. 6, 1983 [DE] Fed. Rep. of Germany ..... 3324330

[51] Int. Cl.[4] ..... A23C 3/04

[52] U.S. Cl. ..... 165/118; 165/174; 138/38; 62/527

[58] Field of Search ..... 165/115, 118, 174; 62/123, 347, 527; 239/37, 193, 194, 590, 590.3; 261/110, 112, 153; 138/38

[56] References Cited

U.S. PATENT DOCUMENTS

| | | | |
|---|---|---|---|
| 1,798,824 | 3/1931 | White | 165/174 |
| 2,424,441 | 7/1947 | Edmonds | 165/174 |
| 2,753,932 | 7/1956 | Eckstrom et al. | 165/118 |
| 2,949,935 | 8/1960 | Edmonds | 138/38 |

FOREIGN PATENT DOCUMENTS

| | | | |
|---|---|---|---|
| 0131213 | 8/1987 | European Pat. Off. . | |
| 46722 | 6/1966 | Fed. Rep. of Germany | 165/118 |
| 166576 | 1/1934 | Switzerland | 165/174 |
| 1458492 | 12/1976 | United Kingdom | 165/118 |

*Primary Examiner*—Noah P. Kamen
*Attorney, Agent, or Firm*—Herbert Dubno

[57] ABSTRACT

A tube-type heat exchanger has the tube ends substantially flush with the upper tube sheet and liquid is distributed to the tubes through distributor heads which are sealed and therefore provide gas cushions absorbing volume changes in the tubes.

11 Claims, 2 Drawing Sheets

TUBE-TYPE HEAT EXCHANGER AND LIQUID DISTRIBUTOR HEAD THEREFOR

CROSS REFERENCE TO RELATED APPLICATION

This application is a continuation-in-part of my copending application Ser. No. 06/892,947, now U.S. Pat. No. 4,799,542, filed Aug. 4, 1986, which is a continuation-in-part of my then copending application Ser. No. 06/628,017 filed July 5, 1984 and now abandoned.

FIELD OF THE INVENTION

My present invention relates to a tube-type heat exchanger and distributor head for causing a liquid to descend in a thin layer along the interior of a tube of such a heat exchanger. In particular, the invention relates to improvements in heat exchangers of the type described in my copending application mentioned above and especially in the thin-film distributor which is received in the upper end of each tube of such a heat exchanger.

BACKGROUND OF THE INVENTION

It is highly advantageous to provide tube-type heat exchangers with distributors which insure that the descending liquid will be present in a uniform thin film along the inner wall of a heat exchanger.

Reference may be made to Europatent No. 0 231 213 and my aforementioned copending application for the principles of thin-film heat exchange between a liquid descending in each of a multiplicity of tubes from a liquid space above the upper tube sheet, and a fluid which fills the space below the upper tube sheet and surrounds the tubes.

Such heat exchangers can be used effectively, for example, in heat pumps and can comprise upper and lower tube sheets in the holes of which heat exchanger tubes can be mechanically and sealingly fixed by rolling them into a force-fit or by a welding operation.

Below the upper tube sheet, the tubes can be surrounded by a coolant, more specifically, a refrigerant such as Freon, filling the boiler which is defined between the upper and lower tube sheets.

The region above the upper tube sheet forms a supply vessel for the heat-yielding medium.

In the upper end of each tube, a distributor head can be provided as described in my aforementioned copending application which has a conically downwardly widening apron defining at a sharp lower edge of the distributor head, between the latter and the inner tube wall, an annular gap having a radial gap width of, for example, 0.1 to 1 mm.

The tube and the distributor head cooperate to ensure that the downwardly flowing liquid will form a film along the inner wall of the tube.

In the preferred application of such a heat exchanger, namely as a heat pump allowing utilization of the heat content of a liquid such as surface water, it had been the practice heretofore to have the tubes project into the interior of the supply vessel. This, however, posed problems with freezing, especially when the surface water had a temperature only slightly above the freezing point.

In this case, the cooling operation brings the water closer to the freezing point and the limited ability of the heat exchanger structure to yield on the formation of ice has been a serious drawback. The danger of freezing has been avoided in conventional systems by providing a distributor head above the region in which the tube is surrounded by the refrigerant, well above the upper tube sheet.

This has the significant drawback that solids like sludge particles, sand grains or the like suspended in surface water tend to accumulate in the spaces on the upper tube sheet below the upwardly projecting lips of the tubes, thereby requiring cleaning of the apparatus and interruption of the continuity of operation.

It is also a disadvantage that a projecting tube above the upper tube sheet cannot be fixed in place as readily as a tube substantially flush therewith and cannot be provided in as close proximity to other tubes because of the need for clearance in rolling the tubes in place in the tube sheet. Even welding is inconvenient by having the tubes project above the upper tube sheet.

OBJECTS OF THE INVENTION

Accordingly, it is the principal object of the present invention to provide a heat exchanger structure whereby these drawbacks are obviated.

It is also an object of the present invention to provide a heat exchanger and a distributor head therefore which advances the principles of the aforementioned copending application.

A further object of my invention is to facilitate manufacture of a heat exchanger by eliminating the need to have the tubes project above the upper tube sheet and thus to provide an improved distributor head which can be used without having the tubes project beyond the upper surface of the upper tube sheet.

SUMMARY OF THE INVENTION

These objects and others which will become apparent hereinafter are attained in accordance with the invention in a tube-type heat exchanger which has a liquid-distribution assembly which comprises:

a generally horizontal upper tube sheet adapted to receive a heat-yielding liquid on an upper surface thereof;

a multiplicity of generally vertical heat exchanger tubes fixed in the upper tube sheet, extending through the upper tube sheet, and having upwardly open ends receiving the heat-yielding liquid, the tubes extending downwardly through a boiler containing a coolant heated by the liquid as the liquid descends in the tubes by heat exchange through walls of the tubes; and a respective distributor head in each of the open ends for spreading the liquid descending in the tubes generally as a layer on inner surfaces of the walls, each of the heads being formed as a unitary hollow body with a downwardly widening frustoconical lower portion having a sharp lower edge defining an annular gap with the respective inner surface, and with an upwardly extending tubular stem closed at an upper end and merging smoothly with the lower portion at a lower end of the stem, the lower portion being downwardly open and having an interior space communicating with the interior of the stem.

Advantageously, the upper ends of the tubes terminate substantially at the upper surface of the upper tube sheet and, more desirably, are flush with the upper surface, having a downwardly flared rim which is formed by a flaring tool against a radiused edge of the bore in which the tube is received.

The upper ends of the stems can be provided with means for facilitating tearing away of the closures of these upper ends and each of the heads can be provided with a plurality of angularly spaced guide ribs which project axially beyond the sharp lower edge of the frustoconically divergent lower portion of the head. This lower portion can be formed with a series of bulges regularly around the periphery of the lower edge.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
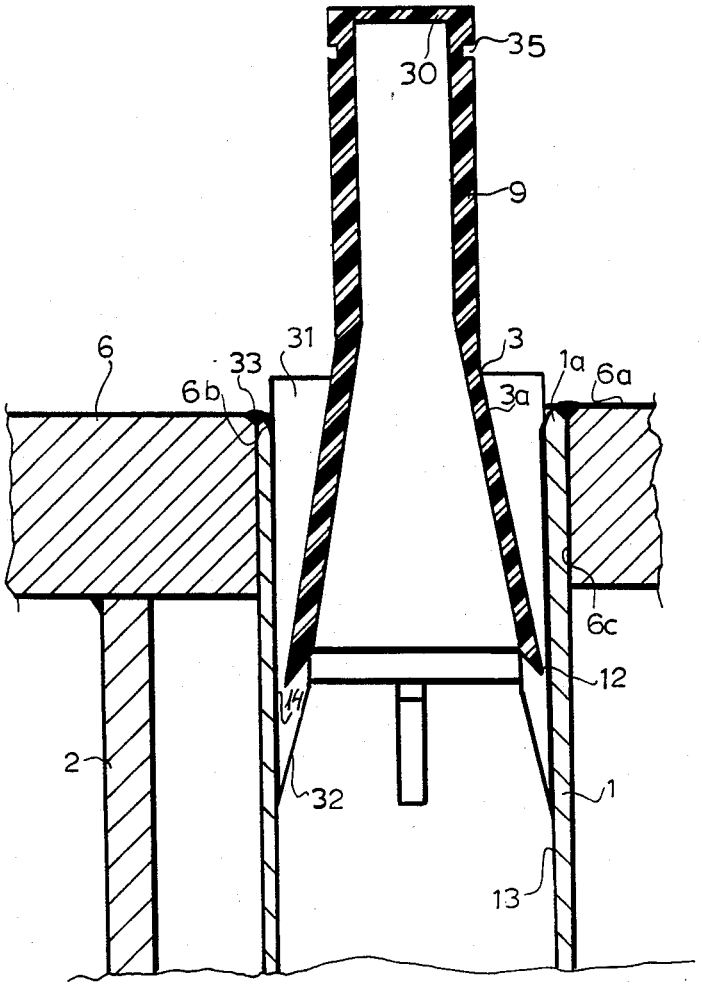
FIG. 1 is a vertical section through a portion of the distributor assembly of a heat exchanger according to the invention, e.g. forming part of a heat pump as otherwise described in the aforementioned application.
Figure 2:
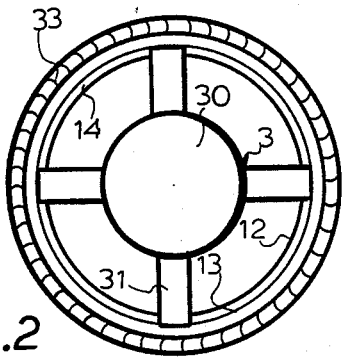
FIG. 2 is an elevational view of the distributor head of FIG. 1.

FIG. 1 shows one heat exchanger tube 1 fixed in an upper tube sheet 6 of a heat exchanger of a heat pump having a multiplicity of such tubes in close proximity to one another.

The tube 1 does not project beyond the upper surface 6*a* of the tube sheet or projects only to a slight degree thereabove. Preferably, as shown, it is flush with the upper surface and weld seams 33 sealingly connects the tube to the tube sheet at an outwardly flared region of the tube which is flared outwardly against a rounded rim 6*b* of the bore 6*c* in which the tube is anchored.

The boiler 2 receives a refrigerant, for example, Freon, and surrounds the tubes 1 between the upper tube sheet 6 and a lower tube sheet which has not been shown.

The distributor head 3 if fitted into the upper end of the tube 1 and, like the distributor in Europatent No. 0 131 213 has an conically widening lower end 3*a* which is formed with a sharp break-away lower edge 12 defining with the inner wall 13 of the heat exchanger tube 1 a narrow annular gap 14.

However, unlike the distributor head of my earlier application and patent, this lower portion is hollow, downwardly open and connected without a sharp transition, i.e. uniformly and gradually with a hollow upwardly extending stem 9, closed at its upper end and by means of which the head can be moved upwardly and downwardly within the tube 1.

The annular gap between the distributor head and the inner wall of the tube ensures that the film of liquid descending in the tube will be fully formed in the freeze-danger zone and also ensures that the interior of the tube will not be plugged so as to prevent the expansion of ice upwardly.

It has been found to be advantageous, moreover, to provide the upper end of the stem 9 with an easily tearable cover 30 by reason of the small thickness thereof. The groove 35 in the stem adjacent the cover serves, as the corresponding groove in the distributor of the prior application to fix the position of the distributor in the tube.

Thus within the distributor head and the stem a flexible air cushion is provided which can elastically absorb most of the forces which might otherwise be disruptive. Upon very sharp and drastic volume increases, the pressure in the air cushion can rupture the cover so that the pressure can be released without damage to the tube.

The head can be provided, moreover, with a plurality, e.g. four, of angularly spaced guide ribs 31 whose free lower ends projecting below the gap-defining edge, can have sharp edges 32.

This has been found to facilitate cleaning of the apparatus from suspended particles like sand and larger contaminant particles.

While in earlier devices using such distributing heads, the head could not be raised until the edge of the frustcone cleared the tube without pulling the head completely out of the tube and preventing automatic return, thereby preventing a cleaning gap of a width in excess of 2 mm from developing, the presence of the guide ribs beyond the lower edge of the frustocone allows the head to be lifted so that a gap width of 10 to 15 mm can be provided while the guide ribs remain engaged in the tube to ensure a reliable return of the head to the original position. With such large cleaning gaps, practically all contaminants can be flushed away with ease.

Figure 3:
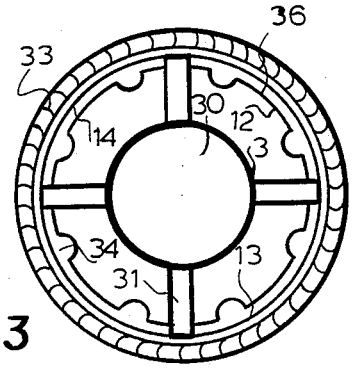
FIG. 3 is a view similar to FIG. 1 but illustrating another embodiment.

In FIG. 3, I have shown an arrangement in which circular-section notches 34 separate bulges or lands 36 in regular spacing around the sharp edge at the lower end of the frustcone 3. The notches or bulges are not detrimental because any flow split by them or distorted by them or the ribs unites directly below the ribs to form the continuous film. However, they do permit a coarse control over the flow cross section and hence the rate at which liquid descends in each tube. Fine control is, of course, effected by control of the static pressure of the liquid above the tube sheet 6.

Utilizing notches of different shapes and dimensions, I am able to achieve with a single tube diameter, a wide range of heat exchange properties. Indeed, the use of notching of the head is also far less expensive and is simpler as a control for the flow past each head than injection molding different heads of a variety of dimensions.

I claim:

1. In a tube-type heat exchanger, a liquid-distribution assembly which comprises:

a generally horizontal upper tube sheet adapted to receive a heat-yielding liquid on an upper surface thereof;

a multiplicity of generally vertical heat exchanger tubes fixed in said upper tube sheet, extending through said upper tube sheet, and having upwardly open ends receiving said heat-yielding liquid, said tubes extending downwardly through a boiler containing a coolant heated by said liquid as said liquid descends in said tubes by heat exchange through walls of said tubes; and a respective distributor head in each of said open ends for spreading said liquid descending in said tubes generally as a layer on inner surfaces of said walls, each of said heads being formed as a unitary hollow body with a downwardly widening frustoconical lower portion having a sharp lower edge defining an annular gap with the respective inner surface, and with an upwardly extending tubular stem closed at an upper end and merging smoothly with said lower portion at a lower end of the stem, said lower portion being downwardly open and having an interior space communicating with the interior of said stem, said upper ends of said tubes terminating substantially at said upper surface.

2. The tube-type heat exchanger defined in claim 1 wherein said upper ends of said tubes terminate flush with said upper surface of said tube sheet.

3. In a tube-type heat exchanger, a liquid-distribution assembly which comprises:

a generally horizontal upper tube sheet adapted to receive a heat-yielding liquid on an upper surface thereof;

a multiplicity of generally vertical heat exchanger tubes fixed in said upper tube sheet, extending through said upper tube sheet, and having upwardly open ends receiving said heat-yielding liquid, said tubes extending downwardly through a boiler containing a coolant heated by said liquid as said liquid descends in said tubes by heat exchange through walls of said tubes; and a respective distributor head in each of said open ends for spreading said liquid descending in said tubes generally as a layer on inner surfaces of said walls, each of said heads being formed as a unitary hollow body with a downwardly widening frustoconical lower portion having a sharp lower edge defining an annular gap with the respective inner surface, and with an upwardly extending tubular stem closed at an upper end and merging smoothly with said lower portion at a lower end of the stem, said lower portion being downwardly open and having an interior space communicating with the interior of said stem, said upper ends of said stems being provided with means for facilitating tearing away closures for the upper ends of said stems.

4. In a tube-type heat exchanger, a liquid-distribution assembly which comprises:

a generally horizontal upper tube sheet adapted to receive a heat-yielding liquid on an upper surface thereof;

a multiplicity of generally vertical heat exchanger tubes fixed in said upper tube sheet, extending through said upper tube sheet, and having upwardly open ends receiving said heat-yielding liquid, said tubes extending downwardly through a boiler containing a coolant heated by said liquid as said liquid descends in said tubes by heat exchange through walls of said tubes; and a respective distributor head in each of said open ends for spreading said liquid descending in said tubes generally as a layer on inner surfaces of said walls, each of said heads being formed as a unitary hollow body with a downwardly widening frustoconical lower portion having a sharp lower edge defining an annular gap with the respective inner surface, and with an upwardly extending tubular stem closed at an upper end and merging smoothly with said lower portion at a lower end of the stem, said lower portion being downwardly open and having an interior space communicating with the interior of said stem, each of said heads being further provided with a plurality of angularly equispaced guide ribs projecting downwardly beyond the respective sharp edges.

5. The tube-type heat exchanger defined in claim 4 wherein each of said ribs is formed with a sharp edge at a lower end thereof.

6. In a tube-type heat exchanger, a liquid-distribution assembly which comprises:

a generally horizontal upper tube sheet adapted to receive a heat-yielding liquid on an upper surface thereof;

a multiplicity of generally vertical heat exchanger tubes fixed in said upper tube sheet, extending through said upper tube sheet, and having upwardly open ends receiving said heat-yielding liquid, said tubes extending downwardly through a boiler containing a coolant heated by said liquid as said liquid descends in said tubes by heat exchange through walls of said tubes; and a respective distributor head in each of said open ends for spreading said liquid descending in said tubes generally as a layer on inner surfaces of said walls, each of said heads being formed as a unitary hollow body with a downwardly widening frustoconical lower portion having a sharp lower edge defining an annular gap with the respective inner surface, and with an upwardly extending tubular stem closed at an upper end and merging smoothly with said lower portion at a lower end of the stem, said lower portion being downwardly open and having an interior space communicating with the interior of said stem, each of said sharp edges of said frustoconical lower portions of said heads being provided with a series of bulges regularly spaced around the respective body.

7. A distributor head for a heat exchanger tube, comprising:

a unitary hollow body with a downwardly widening frustoconical lower portion having a sharp lower edge adapted to define an annular gap with a respective inner surface of a heat exchanger tube, and with an upwardly extending tubular stem closed at an upper end and merging smoothly with said lower portion at a lower end of the stem, said lower portion being downwardly open and having an interior space communicating with the interior of said stem, said upper end of said stem being provided with means for facilitating tearing away of a closure for the upper end of said stem.

8. The distributor head defined in claim 7 wherein said sharp edge of said frustoconical lower portion of said head is provided with a series of bulges regularly spaced around the body.

9. A distributor head for a heat exchanger tube, comprising:

a unitary hollow body with a downwardly widening frustoconical lower portion having a sharp lower edge adapted to define an annular gap with a respective inner surface of a heat exchanger tube, and with an upwardly extending tubular stem closed at an upper end and merging smoothly with said lower portion at a lower end of the stem, said lower portion being downwardly open and having an interior space communicating with the interior of said stem, said bodies being provided with a plurality of angularly equispaced guide ribs projecting downwardly beyond the respective sharp edges.

10. The distributor head defined in claim 9 wherein each of said ribs is formed with a sharp edge at a lower end thereof.

11. A distributor head for a heat exchanger tube, comprising:

a unitary hollow body with a downwardly widening frustoconical lower portion having a sharp lower edge adapted to define an annular gap with a respective inner surface of a heat exchanger tube, and with an upwardly extending tubular stem closed at an upper end and merging smoothly with said lower portion at a lower end of the stem, said lower portion being downwardly open and having an interior space communicating with the interior of said stem, said sharp edge of said frustoconical lower portion of said head being provided with a series of bulges regularly spaced around the body.

* * * * *